US006276243B1

(12) United States Patent
Jenkins

(10) Patent No.: US 6,276,243 B1
(45) Date of Patent: Aug. 21, 2001

(54) ELECTROMECHANICAL RELEASING TORQUE WRENCH

(76) Inventor: Bradley G. Jenkins, 1812 E. Evergreen, Duarte, CA (US) 91010

( * ) Notice: Subject to any disclaimer, the term of this patent is extended or adjusted under 35 U.S.C. 154(b) by 0 days.

(21) Appl. No.: 09/656,901

(22) Filed: Sep. 7, 2000

Related U.S. Application Data

(62) Division of application No. 09/349,930, filed on Jul. 8, 1999, now Pat. No. 6,119,562.

(51) Int. Cl.[7] ..... B25B 23/144
(52) U.S. Cl. ..... 81/479; 81/483
(58) Field of Search ..... 81/467, 478, 479, 81/483; 73/862.21, 862.22, 862.23, 862.24

(56) References Cited

U.S. PATENT DOCUMENTS 4,641,538 * 2/1987 Heyraud ..... 73/862.26
4,958,541 * 9/1990 Annis et al. ..... 81/479
5,503,042 * 4/1996 Larson et al. ..... 74/527
5,537,877 * 7/1996 Hsu ..... 73/862.23
5,662,012 * 9/1997 Grabovac ..... 81/483
6,070,506 * 6/2000 Becker ..... 81/479
6,167,788 * 1/2001 Schonberger et al. ..... 81/467

* cited by examiner

*Primary Examiner*—Joseph J. Hail, III
*Assistant Examiner*—Dung Van Nguyen
(74) *Attorney, Agent, or Firm*—Albert O. Cota

(57) ABSTRACT

An electromechanical releasing torque wrench which includes an electronic controller (50) and transducers (32) or (34) to measure and actuate a release of the wrench with physical, audible and visual signals. In operation, the user sets the desired torque-release-point on the keypad (60) of the electronic controller and then attaches the wrench to a workpiece with the ratchet means which pivotally protrudes from the enclosure (20). The user tightens the workpiece, normally a threaded fastener, and the force sensing means attached to the ratchet (28) or (62) produce an analog signal to the controller. When the release point is reached the controller sends a signal to a solenoid (44) or linear actuator (66) creating linear mechanical motion causing the mechanical advantage locking latch and trigger means to disconnect the ratchet producing a momentary reduction of force felt by the operator and an audible clicking sound as the ratchet strikes the enclosure.

8 Claims, 8 Drawing Sheets

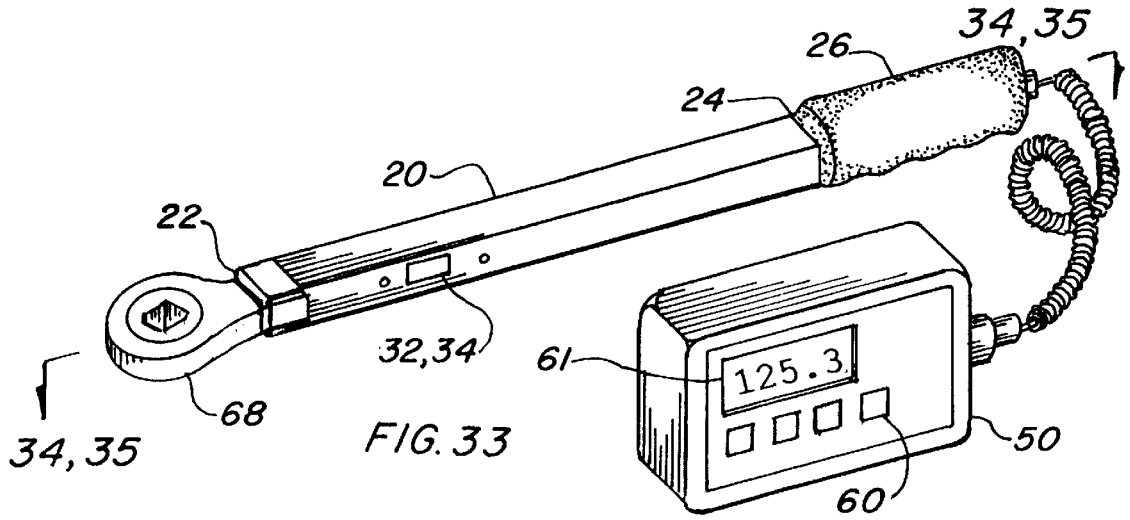
FIG. 33
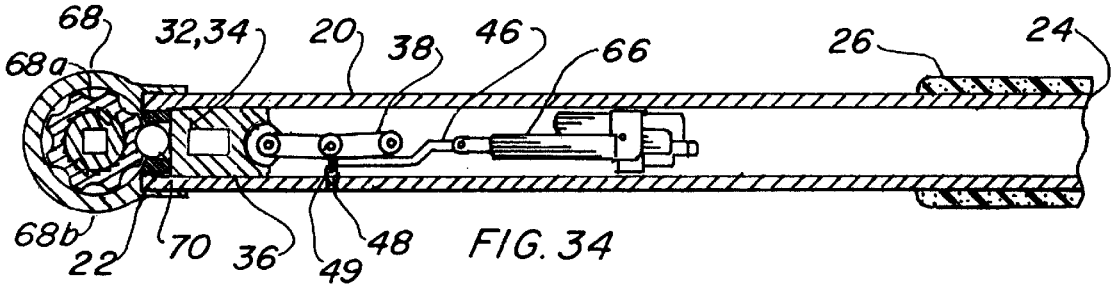
FIG. 34
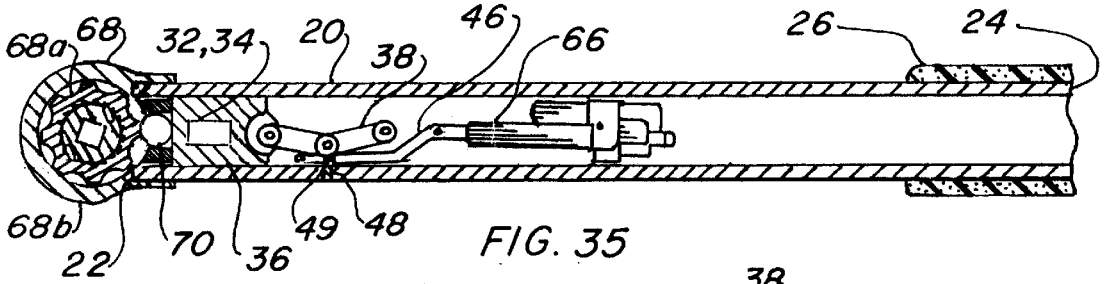
FIG. 35
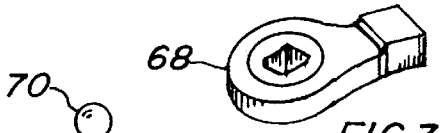
FIG.37
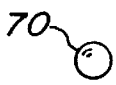
FIG.36
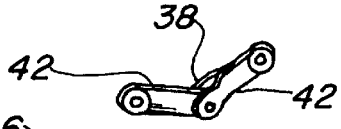
FIG. 38
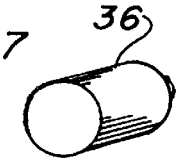
FIG. 41
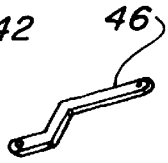
FIG. 39
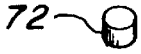
FIG. 40
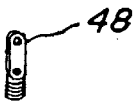
FIG. 42
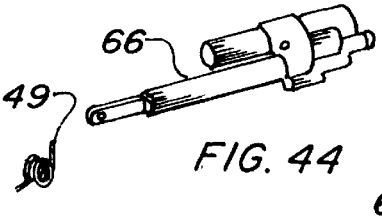
FIG. 44
FIG. 43
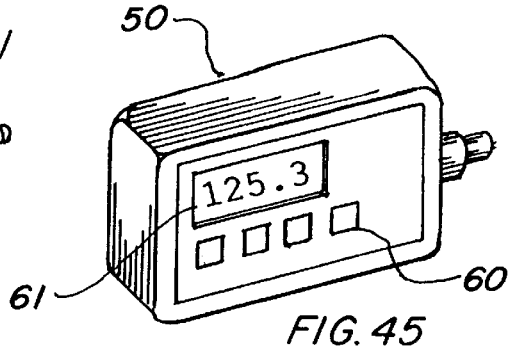
FIG. 45

ELECTROMECHANICAL RELEASING TORQUE WRENCH

This is a Divisional application of application Ser. No. 09/349,930, filed Jul. 8, 1999 now U.S. Pat. No. 6,119,562.

TECHNICAL FIELD

The invention relates to torque wrenches in general and more particularly to a torque wrench that disengages at a predetermined adjustable value by electronically sensing torque and releasing force using electronically actuated linkage while simultaneously creating and audible clicking sound.

BACKGROUND ART

Previously, many types of torque wrenches have been used to provide an effective means for tightening threaded fasteners to a predetermined value of tension. In the past mechanical wrenches have utilized spring tension to determine the amount of torque applied to tighten a threaded fastener. These wrenches historically employ a mechanism that uses some type of metallic member that is released when the desired torque is obtained, thus striking the housing or other part of the wrench to produce a distinct mechanical release and to produce a distinct sound, such as an audible "click". Further, industry has developed specialty wrenches that include electronic means for measuring the amount of torque applied to a structure in response to the manual application of force independent of the position of the user's hand.

A search of the prior art did not disclose any patents that read directly on the claims of the instant invention, however the following U.S. patents are considered related:

| U.S. Pat. No. | INVENTOR | ISSUED |
|---|---|---|
| 5,741,186 | Tatsuno | 21 April 1998 |
| 5,662,012 | Garbviac | 2 September 1997 |
| 5,643,089 | Hummel | 1 July 1997 |
| 5,156,072 | Muralidharan | 20 October 1992 |
| 5,142,951 | Walton | 1 September 1992 |
| 4,982,612 | Rittmann | 8 January 1991 |
| 4,864,841' | Heyraud | 12 September 1989 |
| | Foreign patent Documents | |
| 3534520 | Germany | 9 April 1987 |
| 2829009 | Germany | 10 January 1980 |
| 2651636 | Germany | 24 May 1978 |
| 2338304 | Germany | 30 October 1975 |
| 0372247 | European Patent | 9 November 1989 |
| 0360894 | European Patent | 9 September 1988 |

Tatsuno in U.S. Pat. No. 5,741,186 teaches an impulse torque generator for a hydraulic impulse torque wrench. The generator includes a liner driven by a rotor. The liner has an inner cavity having two pairs of sealing surfaces around its inner peripheral surface. A main shaft extends through the liner having projections and driving blades that generate the torque on the shaft by abutting the projections.

Grabivac discloses in U.S. Pat. No. 5,662,012 an adjustable click-type torque wrench. Adjustment is accomplished by a carrier nut engaging the rear end of a lever arm that is contiguous with a spring.

U.S. Pat. No. 5,643,089, issued to Hummel, discloses a non-jarring design that resets the wrench without jarring the output shaft after it delivers the preset maximum torque. The wrench utilizes interchangeable output shafts such that a variety of different drive tips may be employed with the same handle. The cam surfaces of the output shafts have unique surfaces to accommodate varying torque value.

Muralidharan in U.S. Pat. No. 5,156,072 discloses a mechanical torque wrench that employs a plurality of levers. A first lever is journalled to an output shaft for rotation and the remaining levers are pivotally secured to a housing adjacent with their ends along the longitudinal direction of the wrench handle. The torque value is adjusted by changing the force to be overcome by the lever to the pivot.

U.S. Pat. No. 5,142,951 issued to Walton discloses a torque wrench that utilizes a hydraulic piston-cylinder assembly, which rotates a member around an axis located perpendicular to the wrench body. A reaction member is attached to the body and is pivoted relative to the axis between different positions extending angularity out from the body.

Rittmann in U.S. Pat. No. 4,982,612 teaches a torque measuring wrench using a deflection beam, with four strain gauges mounted thereon. One gauge is positioned on a reduced cross-sectional area and the other is closer to the ratchet head. A tubular handle encloses a battery-powered control circuit having indicating means, which provides measurements that are independent of the position along the handle at which the force is applied.

U.S. Pat. No. 4,864,841 issued to Heyraud discloses an electronic wrench that employs two strain gauges that are placed on either side of a crosswise plane. An electronic circuit determines and stores a constant factor for calibration, and the value of torque is measured by the strain gauges and displayed.

For background purposes and as indicative of the art to which the invention is related reference may be made to the remaining cited foreign patents.

DISCLOSURE OF THE INVENTION

Currently there is great demand for wrenches that measure the amount of torque applied to a threaded fastener. The ultimate strength of a fastener cannot be achieved without controlling the amount of torque, since too much can easily break the fastener, thereby leaving a stub inside, which creates difficulty in its removal, particularly if the fastener, such as a capscrew or bolt, is attached to a threaded hole. In the past mechanical tools have been used, and, due to wide spread distribution have become a commonplace and relatively inexpensive. There are numerous drawbacks however, as their accuracy is only passable in some circumstances, as it is affected by ambient conditions, deterioration or relaxation of springs due to time also mechanical wear on moving parts. Scales are permanently marked therefore if some degree of improved accuracy is desired it is necessary to calibrate the tool with a separate gauge or fixture.

The most popular type of torque wrench is called a micrometer or clicking torque wrench and has a hollow arm which includes a spring and pawl mechanism for setting torque. Within the hollow arm, the pawl is forced against one end of a bar that is connected to a drive end. The bar and a drive head are pinned to the hollow arm and rotate as torque is applied. The pawl is released when the force applied by the bar increases beyond a set value established by the operator. When released, the bar hits the inside of the arm, thus producing a sound and a distinct feel by a user. The torque value or release point is changed by rotating the handle, which moves on threads for setting. Additionally, values are permanently stamped or imprinted on a scale that is located on an outer surface of the hollow arm.

The accuracy of the wrench is approximately 4% of the rated setting with the calibration process extremely labor intensive. This type of wrench permits a false sense of accuracy as the actual torque applied by the user may be significantly different than the value imprinted on the handle. This results in inaccurate applications of torque since the release point is significantly affected by temperature, spring rate, mechanical wear that occurs over time, and the rate at which the user applies the torque. None of these factors are compensated for as the scale is permanently imprinted on the handle.

These wrenches also overtorque when the operator continues to apply pressure after release, due to the momentum created by the releasing mechanism. This overtorque may occur without the user even realizing it.

Another well known wrench type is called a "cam-over" wrench wherein a ball bearing or roller is held within a detent. A spring holds the ball within the detent and when the torque on the drive overcomes the spring force on the ball, the ball displaces and the ratchet rotates. This wrench is efficient in that it does not create overtorque however, it has all the same problems as a mechanical wrench which is highly reliant on spring characteristics, wear, calibration difficulties, and it is basically more expensive.

In order to overcome the above difficulties, prior art has developed an electronic or digital torque wrench. This type of wrench uses a plurality of strain gauges which are applied to measure deflection in a solid beam member and provide electrical output signals to determine and display torque values. Such torque values are typically displayed on easily readable digital readout devices. These wrenches are appreciably more accurate (0.5%) and display the torque applied to the fastener. The torque values may be stored in a computer memory and used for traceability. The most significant problem that limits the market of this type of wrench is that it does not physically release or click therefore the user must relay on a visual light or an audible buzzer.

Therefore the primary object of the invention is to provide a torque wrench that uses a combination of electronics for accuracy, and a mechanical release and so called "click" that permits the familiar feel that a user has become accustomed to. This combination which is novel and unique relies on old principles known to those knowledgeable in the industry and current state of the art of miniaturized electronics. Further, the size and shape of the invention is well recognized and acceptable to users.

An important object of the invention is that the wrench not only signals the operator by the feel of the release and audible clicking sound, but also by a buzzer, light and visual indication of the actual torque value at the time of release.

Another object of the invention is the durability of the wrench. When compared with other torque wrenches presently available, this wrench has few moving parts that are designed so that wear will not affect the torque accuracy.

Still another object of the invention is the elimination of an overtorque problem of prior art due to momentum after release has occurred. The invention provides a visual display the exact torque at the instant of release. Therefore if the user continues to torque the wrench or if the impact of the pawl within the wrench have any effect on the outcome, it is immediately realized and may be easily compensated for.

Yet another object of the invention is the case of adjustment as the electronics include a switch plate with pressure sensitive pads permitting the user to simply dial in the torque value desired and confirm the setting on the visual display.

A further object of the invention is that the wrench is simple to calibrate and does not require matching or replacing components as does prior art in the all mechanical version.

These and other objects and advantages of the present invention will become apparent from the subsequent detailed description of the preferred and other embodiment also the appended claims, further, taken in conjunction with the accompanying drawing.

BRIEF DESCRIPTION OF THE DRAWINGS

FIG. 33 is a partial isometric view of the fourth embodiment.

FIG. 34 is a cross sectional view taken along lines 34—34 of FIG. 33 with the wrench illustrated prior to release.

FIG. 35 is a cross sectional view taken along lines 35—35 of FIG. 33 with the wrench illustrated after release.

FIG. 36 is a partial isometric view of the cam-over wrench ball completely removed from the invention for clarity.

FIG. 37 is a partial isometric view of the cam-over arm completely removed from the invention for clarity.

FIG. 38 is a partial isometric view of the toggle linkage completely removed from the invention for clarity.

FIG. 39 is a partial isometric view of the trigger lever arm completely removed from the invention for clarity.

FIG. 40 is a partial isometric view of the cam-over wrench roller completely removed from the invention for clarity.

FIG. 41 is a partial isometric view of the holding cam completely removed from the invention for clarity.

FIG. 42 is a partial isometric view of the collapsing column completely removed from the invention for clarity.

FIG. 43 is a partial isometric view of the reset spring completely removed from the invention for clarity.

FIG. 44 is a partial isometric view of the linear actuator completely removed from the invention for clarity.

FIG. 45 is a partial isometric view of the remote electronic controller completely removed from the invention for clarity.

BEST MODE FOR CARRYING OUT THE INVENTION

The best mode for carrying out the invention is presented in terms of a first through sixth embodiment. The basic function of all of the embodiments are the same and they share some identical elements while others have a common purpose but differ slightly in configuration.

Figure 67:
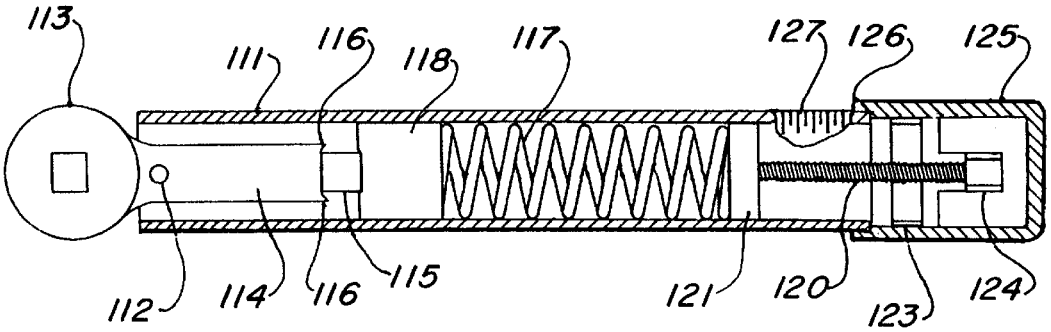
FIG. 67 PRIOR ART
FIG. 67 is a cross sectional view of a prior art micrometer torque wrench prior to release.
Figure 68:
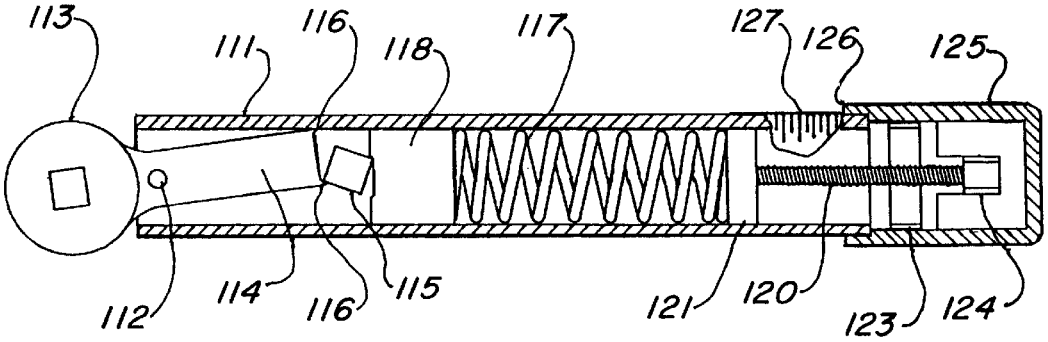
FIG. 68 PRIOR ART
FIG. 68 is a cross sectional view of a prior art micrometer torque wrench after release.

In order to fully understand the desired function of the instant electromechanical releasing torque wrench it may be advantageous to describe the mechanics of a prior art micrometer or so called "clicking" torque wrench, as illustrated in FIGS. 67 and 68, prior to and after release, respectively. This type of torque wrench includes an outer arm 111 which is typically cylindrical in form, although rectangular arms are also utilized. A drive piece 113, which usually includes a ratchet, is pivotally connected to one end of the arm 111 by a pin 112. The drive piece 113 is shaped at one end like a bar 114, which is inserted into a hollow cylindrical interior of the arm 111 and bears against a pawl 115 located within the arm 111. A spring 117 in the hollow cylindrical interior of the arm 111 pushes against a cam 118 which holds the pawl 115 in place against the bottom of the bar 114 between projecting edge 116. The spring 117 may be compressed by rotating a screw 120 to displace a push block 121. The screw 120 moves in threads of a plug 123 which are fixed in position with respect to the arm 111 generally by a press fit or by pins. A handle 125 fits over an end of the screw 120 and causes the screw to rotate with the handle. The handle moves with the screw 120 and has an edge 126 adjacent a scale 127 that is normally stamped into the outer surface of the arm 111. The stamped scale 127 provides markings for adjusting the torque that is applied by the wrench.

It may be seen in FIG. 68 that when torque is applied to the drive piece 113, the drive piece rotates around the pin 112. The pawl 115, however, is held by edges 116 on the bar 114, and holds the bar of the drive piece 113 fixed until the torque overcomes the force applied by the spring 117 and the pawl 115 rotates on the upper surface of the cam 118. When the pawl 115 rotates, the bar 114 of the drive piece 113 is released and moves against an interior cylinder wall of the arm 111 with an audible click. This click and the momentary release of force on the drive piece are sensed by the user to indicate that the torque value set on the scale 127 has been reached.

In order to assure that the torque values are accurate, the springs, particularly in the value of the spring constant, the pawl surface dimensions, and the cam surface dimensions must be carefully selected and, accurately manufactured. In addition, the wrench must be initially calibrated so that the torque values are correct at both the lower and upper ends of the scale. The lower end of the scale is adjusted fairly easily by moving a bottom nut 124 so that the handle moves up and down on the hollow arm until a marked position on the edge 126 of the handle 125 is adjacent the lowest value on the scale, this value is typically twenty percent (20%) of the full scale reading. The lower position is tested against a known torque applied to the drive after each adjustment until the value of the torque is correct at corresponding points of the scale.

The upper end of the scale is much harder to adjust and can be accomplished only after the bottom end has been calibrated. The upper position is tested against a known torque applied to the drive until the value of torque applied matches the setting at the highest point of the scale. If the torque value does not initially match the value on the scale against the mark on the edge 126, the setting is adjusted by replacing the pawl 115 with a pawl which is either thicker or thinner. This requires removement of the drive piece 113 by driving the pin 112 out such that a new pawl may be inserted. The highest reading on the scale is again measured against the torque value anticipated at the upper position. If this is still incorrect, the process must be repeated. It is apparent that obtaining the correct adjustment can be a very labor intensive operation. In some exceptional cases the spring must also be replaced, thus resulting in further labor and expense. Variations in spring constants, surface finish, lubrication and material hardness make it necessary to check each wrench individually for correct pawl thickness.

Having this knowledge of prior art it is obvious to visualize why improvements need to be made for this type of wrench.

Referring now to the first and preferred embodiment of the instant invention, which is illustrated in FIGS. 1–10 and 66, the electromechanical torque wrench is comprised of an enclosure 20 that is a hollow round metallic structure and tubular in shape. While this circular outline form is preferred square rectangular, irregular, polygonal, oval etc. may also be used as long as it is sufficiently hollow to encase operable elements inside, further, similar materials may be used however metal is preferred. The enclosure 20 has a first end 22 and a second end 24 with a handle 26 attached upon the second end. The handle 26 is of a resilient material and is well known in the art. The length of the enclosure 20 is determined by the desired capacity of the torque wrench and is governed the average ability of the user to apply force to a lever arm.

Figure 1:
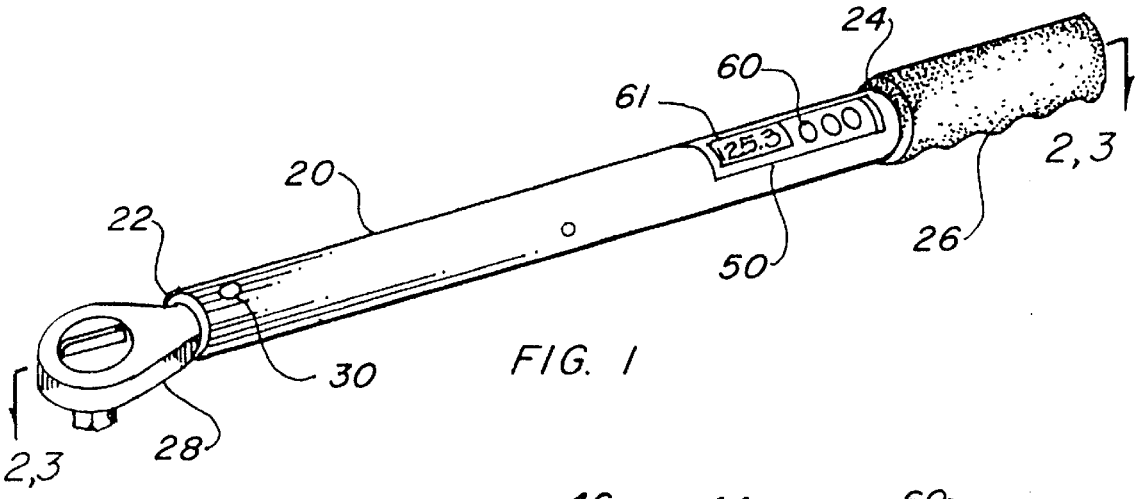
FIG. 1 is a partial isometric view of the first and preferred embodiment.
Figure 2:
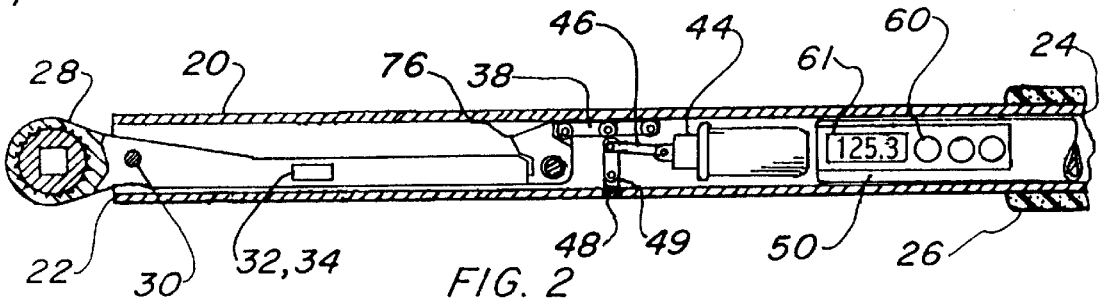
FIG. 2 is a cross sectional view taken along 2—2 of FIG. 1 with the wrench illustrated prior to release.
Figure 3:
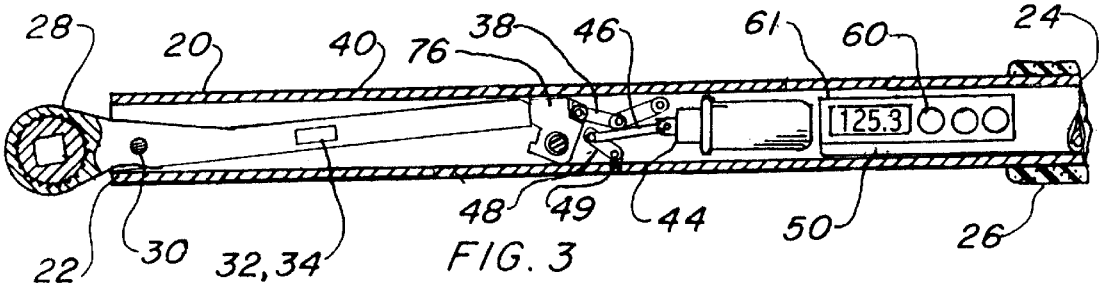
FIG. 3 is a cross sectional view taken along 3—3 of FIG. 1 with the wrench illustrated after release.
Figure 4:
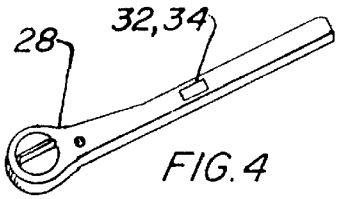
FIG. 4 is a partial isometric view of the square drive ratchet arm completely removed from the invention for clarity.
Figure 5:
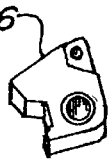
FIG. 5 is a partial isometric view of the holding pawl completely removed from the invention for clarity.
Figure 6:
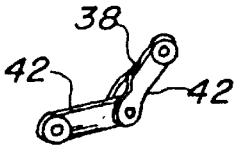
FIG. 6 is a partial isometric view of the toggle linkage completely removed from the invention for clarity.
Figure 7:
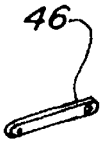
FIG. 7 is a partial isometric view of the trigger lever arm completely removed from the invention for clarity.
Figure 8:
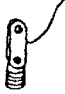
FIG. 8 is a partial isometric view of the collapsing column completely removed from the invention for clarity.
Figure 9:
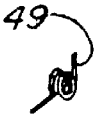
FIG. 9 is a partial isometric view of the reset spring completely removed from the invention for clarity.
Figure 10:
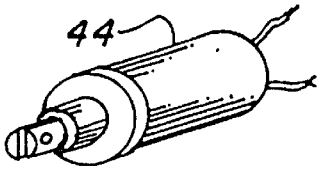
FIG. 10 is a partial isometric view of the electronic magnetic solenoid completely removed from the invention for clarity.

Ratchet means in the form of a square drive ratchet 28 with an extending arm and operable mechanism to reverse direction of the ratchet is disposed within the first end 22 of the enclosure 20, as shown in FIGS. 1–3. The square drive ratchet 28 is well known in the industry is obviously used for attachment and rotation of a threaded fastener workpiece such as a nut, bolt, hex capscrew etc.

Ratchet pivot means in the form of a pivot pin 30 that penetrates through both the enclosure first end 22 and the square drive ratchet 28 permits the ratchet to swivel circuitously within boundaries of the enclosure 20. This limited rotational movement is illustrated in FIGS. 2 and 3, wherein FIG. 2 depicts the wrench prior to release and FIG. 3 shows the wrench after it has released, thus depicting the relative movement that has been allowed within boundaries created by the shape of the enclosure 20.

Force sensing means in the form of either a strain gauge transducer 32 or a force cell transducer 34 is permanently attached, with epoxy or the like, onto the square drive ratchet 28 and its function is to convert physical torque value energy into an analog electronic signal. Both transducers are similar in function and are illustrated only as a rectangle in the drawings since they are well known, commonly available and in present use.

Locking latch means are in the form of a holding pawl 76 and toggle linkage 38 with the holding pawl 76 configured to pivot within the enclosure 20 and a first side abut against the extended end of the square drive ratchet's arm. The ratchet arm 28 is held in a fixed rigid position by the interface of the square end of the arm 28 engaging a notch in the pawl 76 until a predetermined amount of torque is applied to the wrench. The toggle linkage 38 consists of a pair of pivoted toggle arms 42 attached together with one end affixed rotatably to a second side of the holding pawl 76 and the other end pivotally connected to the enclosure 20. The arms 42 are in biased alignment maintaining the ratchet 28 in a fixed rigid position within the notch of the holding pawl 76 until a predetermined amount to torque is applied to the wrench where the alignment is disrupted permitting the ratchet arm 28 to rotate from its position in the notch of the pawl 76.

Electromechanical actuated trigger means is in the form of an electromagnetic solenoid 44 having a bobbin and a plunger with the plunger producing a linear motion or action when the bobbin is supplied with an electrical current creating an electromagnetic field forcing the plunger to be propelled, by reversed magnetic polarity, in a longitudinal direction. A trigger layer am 46 and a collapsing column 48 are used to support the toggle arms 42 in parallel alignment disallowing movement of the ratchet 28 until the lever arm 46 is thrust outwardly by the solenoid 44 upon which one end is attached. The other end of the lever arm 46 is rotatably connected to the column 48 and the column is affixed to the enclosure 20. FIGS. 2 and 3 illustrate this relationship, with FIG. 2 showing the lever arm 46 and column 48 supporting the toggle arms 42. When the solenoid 44 is energized, as depicted in FIG. 3, the toggle arms 42 are released and collapse downward from their biased position thus releasing the ratchet 28 from the indentation 40 in the holding cam 36 striking the inside of the enclosure 20 due to the momentum created by the operator applying torque to the wrench. The impact of the ratchet 28 creates the desired audible clicking sound that is indeed familiar to the user.

Figure 11:
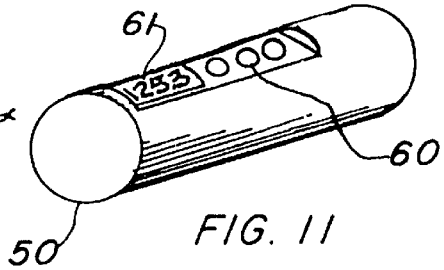
FIG. 11 is a partial isometric view of the electronic controller completely removed from the invention for clarity.
Figure 66:
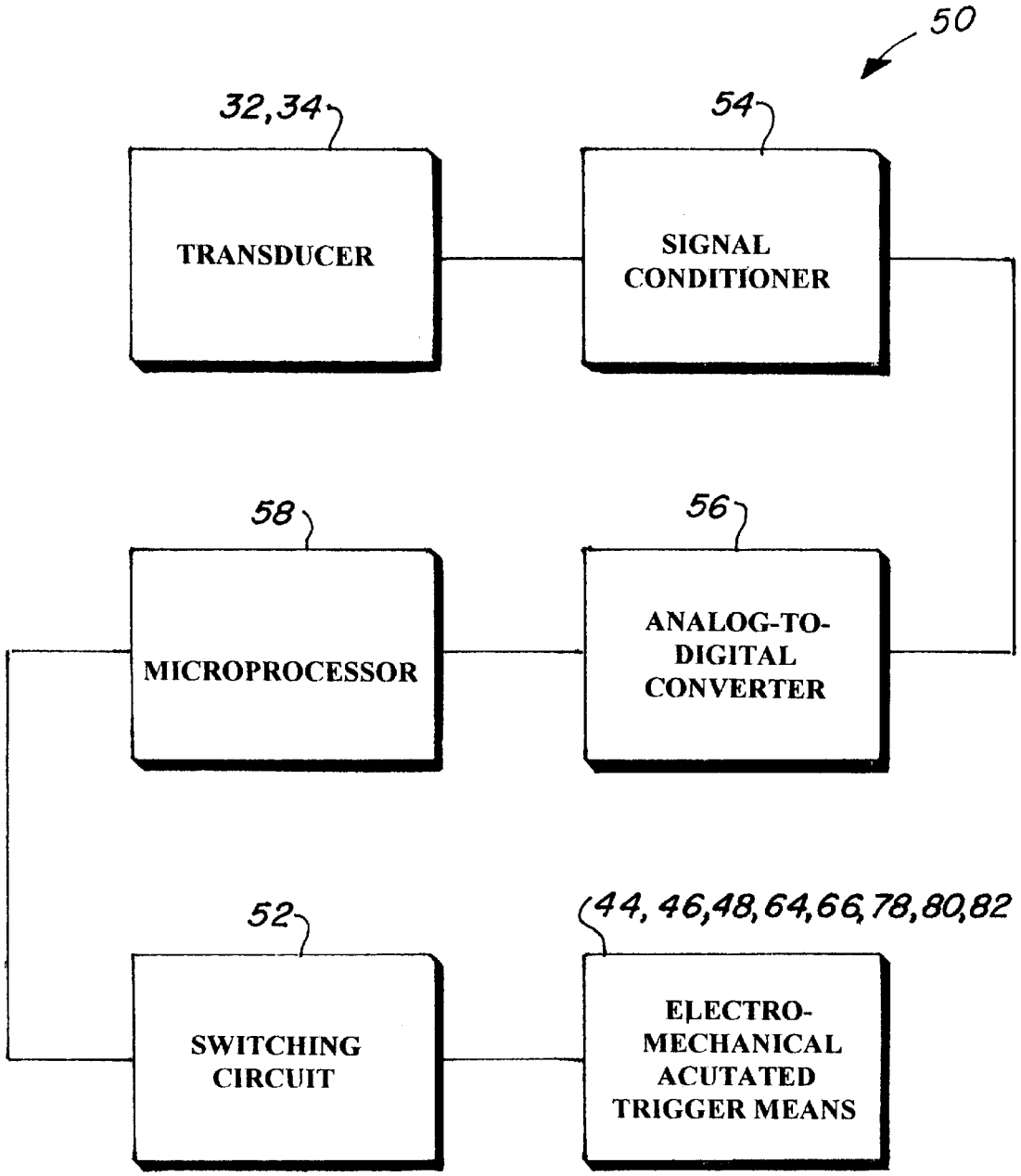
FIG. 66 is a block diagram of the interrelated function of the electronic controller.

An electronic controller 50, shown in block diagram in FIG. 66 and by itself in FIG. 11, amplifies and conditions a signal from the force sensing means, either a strain gauge 32 or a force cell transducer 34, and utilizes a switching circuit 52 to control the solenoid 44. The controller 50 includes a signal conditioner 54 that receives, conditions and amplifies the analog signal from the transducer 32 or 34. An analog-to-digital converter 56, integral with the controller, converts the conditioned and amplified analog signal into an equivalent digital signal. An electronic controller such as a microprocessor 58 is included that has the ability to enter a torque-release set point corresponding to the torque-release value required by the user. The microprocessor receives and compares the digital signal with the torque-release set point such that when the digital signal and torque-release point are equal, a wrench release signal is produced and applied to the switching circuit 52. The wrench release signal energizes the trigger means and releases the ratchet means which results in a momentary reduction in force felt by the operator and the production of an audible clicking sound. The strain gauge transducer 32 utilizes a wheatstone-bridge, such as a strain gauge circuit and the means for entering a torque-release set point constitutes a keypad 60. A digital readout 61, preferably an LCD is included to indicate the torque-release value set point and the absolute value at the point of release Memory in the microprocessor 58 may store and indicate former value, also, an annunciator and light may be provided to indicate audibly and visually that the release point has been achieved.

The second embodiment of the instant invention, which is illustrated in FIGS. 12–22 and 66, the electromechanical torque wrench is comprised of a hollow, metallic tubular enclosure 20. While the tubular form is preferred, square, rectangular, irregular, polygonal, oval, etc. may also be used, as long as the form is sufficiently hollow to encase operable elements. Further, similar materials may be used however, metal is preferred. The enclosure 20 has a first end 22 and a second end 24, with a handle 26 attached upon the second end. The handle 26 is of a resilient material and is well known in the art. The length of the enclosure 20 is determined by the desired capacity of the torque wrench and is governed by the average ability of the user to apply force to a lever arm.

Figure 12:
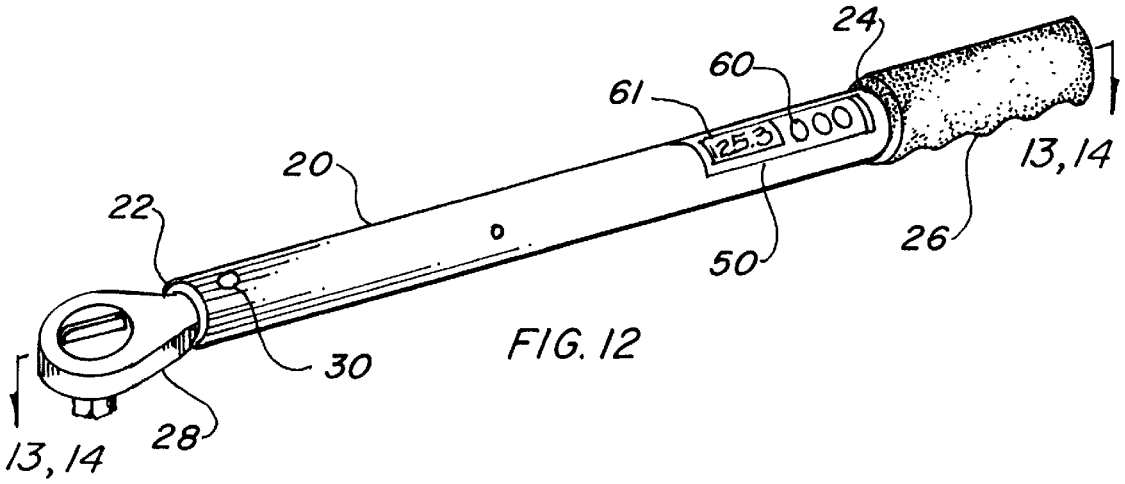
FIG. 12 is a partial isometric view of the second embodiment.
Figure 13:
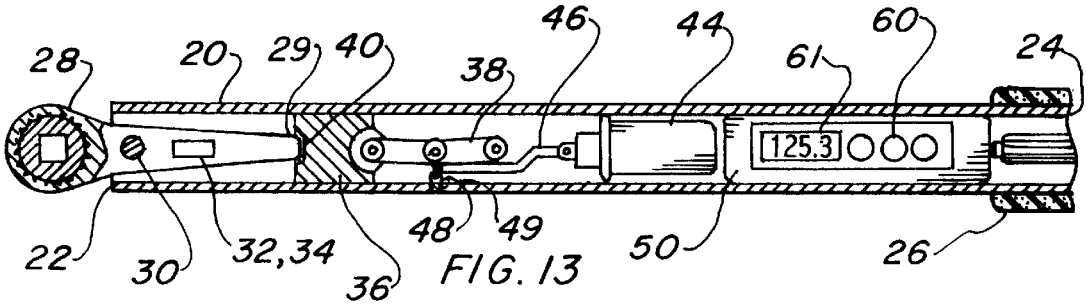
FIG. 13 is a cross sectional view taken along 13—13 of FIG. 12 with the wrench illustrated prior to release.
Figure 14:
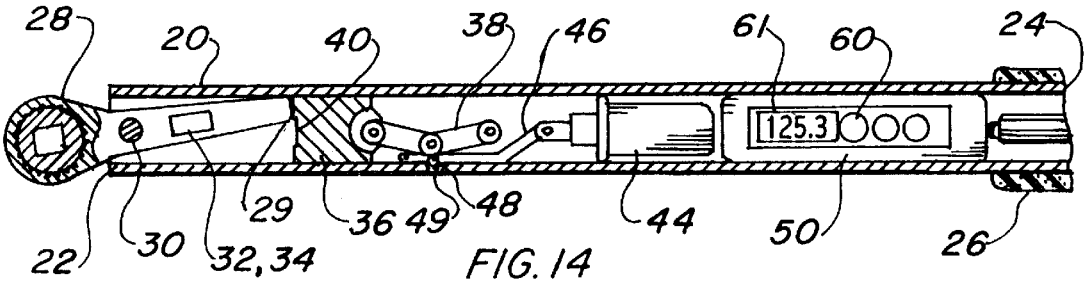
FIG. 14 is a cross sectional view taken along 14—14 of FIG. 12 with the wrench illustrated after release.
Figure 15:
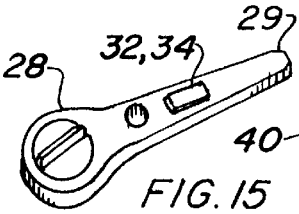
FIG. 15 is a partial isometric view of the square drive ratchet arm completely removed from the invention for clarity.
Figure 16:
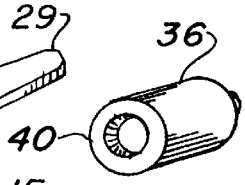
FIG. 16 is a partial isometric view of the holding pawl completely removed from the invention for clarity.
Figure 17:
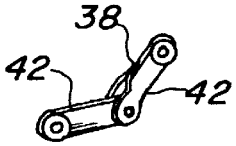
FIG. 17 is a partial isometric view of the toggle linkage completely removed from the invention for clarity.
Figure 18:
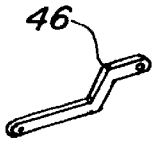
FIG. 18 is a partial isometric view of the trigger lever arm completely removed from the invention for clarity.
Figure 19:
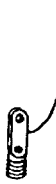
FIG. 19 is a partial isometric view of the collapsing column completely removed from the invention for clarity.
Figure 20:
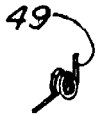
FIG. 20 is a partial isometric view of the reset spring completely removed from the invention for clarity.
Figure 21:
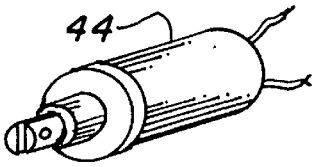
FIG. 21 is a partial isometric view of the electronic magnetic solenoid completely removed from the invention for clarity.

Ratchet means in the form of a square drive ratchet 28 with an extending arm and operable mechanism to reverse direction of the ratchet, are disposed within the first end 22 of the enclosure 20, as shown in FIGS. 12–14. The square drive ratchet 28 is well known in the industry and is obviously used for attachment and rotation of a threaded fastener workpiece such as nut, bolt, hex capscrew, etc.

Ratchet pivot means in the form of a pivot pin 30 that penetrates through both the enclosure's first end 22 and the square drive ratchet 28 permits the ratchet to swivel circuitously within boundaries of the enclosure 20. This limited rotational movement is illustrated in FIGS. 13 and 14, wherein FIG. 13 depicts the wrench prior to release and FIG. 14 shows the wrench after it has been released, thus depicting the relative movement that has been allowed within boundaries created by the shape of the enclosure 20.

Force sensing means, in the form of either a strain gauge transducer 32 or a force cell transducer 34 is permanently attached, with epoxy or the like, onto the square drive ratchet 28, and its function is to convert physical torque value energy into an analog electronic signal. Both transducers 32, 34 are similar in function and are illustrated only as a rectangle in the drawings since they are well known, commonly available and in present use.

Locking latch means are in the form of a holding cam 36 and toggle linkage 38, with the holding cam 36 configured to slide within the enclosure 20 and abut against the extended end of the square drive ratchet's arm 28. The ratchet arm 28 has a truncated conical end 29 which creates a small axial force. As the enclosure 20 is tubular in shape the holding cam 36 is likewise formed as a cylinder which is sized to slide freely within the enclosure. The holding cam 36 includes a truncated conical indentation 40 on an end that contiguously holds the ratchet arm 28 in a rigid position until a predetermined amount of torque is applied to the wrench by converting force to an analog signal. The toggle linkage 38 consists of a pair of pivoted toggle arms 42 attached together with one end rotatably affixed to the holding cam 36, and the other end pivotally connected to the enclosure 20. The arms 42 are in a biased alignment, thus maintaining the ratchet 28 in a fixed rigid position within the truncated conical indentation 40 of the holding cam 36 until a predetermined amount to torque is applied to the wrench where the alignment is disrupted.

Electromechanical actuated trigger means is in the form of an electromagnetic solenoid 44 having a bobbin and a plunger. The plunger produces a linear motion or action when the bobbin is supplied with an electrical current, thereby creating an electromagnetic field which forces the plunger to be propelled, by reversed magnetic polarity, in a longitudinal direction. A trigger lever arm 46 and a spring loaded collapsing column 48 using a reset spring 49 are used to support the toggle arms 42 in a biased alignment, thus disallowing movement of the ratchet 28 until the lever arm 46 is thrust outward by the solenoid 44 upon which one end is attached. The other end of the lever arm 46 is rotatably connected to the column 48, and the column is affixed to the enclosure 20. FIG. 13 and 14 illustrate this relationship, with FIG. 13 showing the lever arm 46 and column 48 supporting the toggle arms 42. When the solenoid 44 is energized, as depicted in FIG. 14, the toggle arms 42 are released and collapse downward from their biased position. This action creates a momentary reduction in force felt by the operator resulting in a physical release of the ratchet 28 from the truncated conical indentation 40 in the holding cam 36 striking the inside of the enclosure 20 due to the momentum created by the operator applying torque to the wrench. The impact of the ratchet 28 creates the desired and familiar audible clicking sound.

Figure 22:
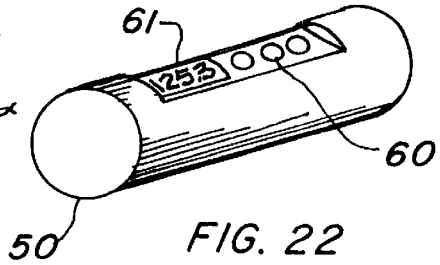
FIG. 22 is a partial isometric view of the electronic controller completely removed from the invention for clarity.

An electronic controller 50, shown in block diagram in FIG. 66 and by itself in FIG. 22, amplifies and conditions a signal from the force sensing means, which is either a strain gauge transducer 32 or a force cell transducer 34, and utilizes a switching circuit 52 to control the solenoid 44. The controller 50 utilizes all of the same elements and functions as described in the first or preferred embodiment, with the exception of its shape which is packaged differently, as depicted in FIG. 22.

The third embodiment of the invention, illustrated in FIGS. 23–32 and 66 is comprised of a hollow, metallic enclosure 20 that is irregular in its preferred shape. The enclosure 20 has a first end 22 and a second end 24, with a handle 26 attached upon the second end. The handle 26 is of a resilient material and is well known in the art. The length of the enclosure 20 is determined by the desired capacity of the torque wrench and is governed the average ability of the user to apply force to a lever arm.

Figure 23:
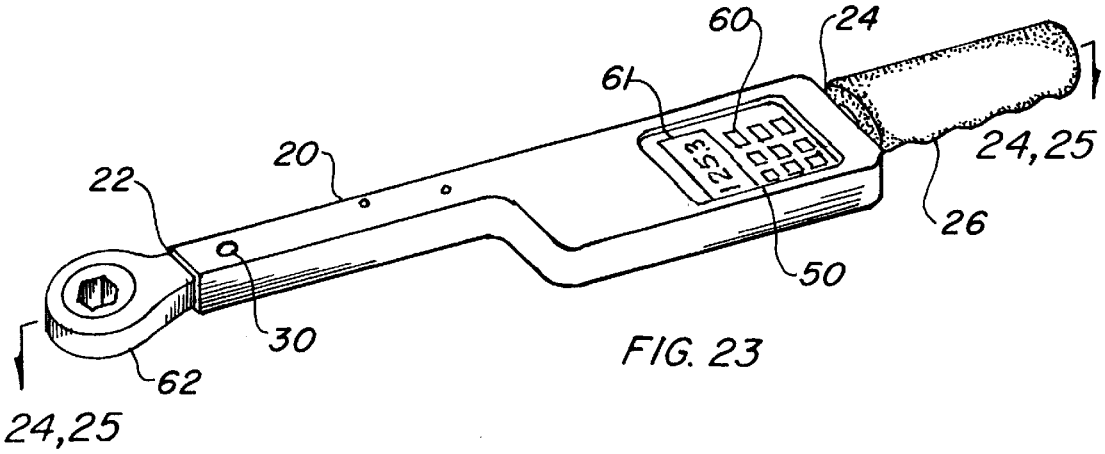
FIG. 23 is a partial isometric view of the third embodiment.
Figure 24:
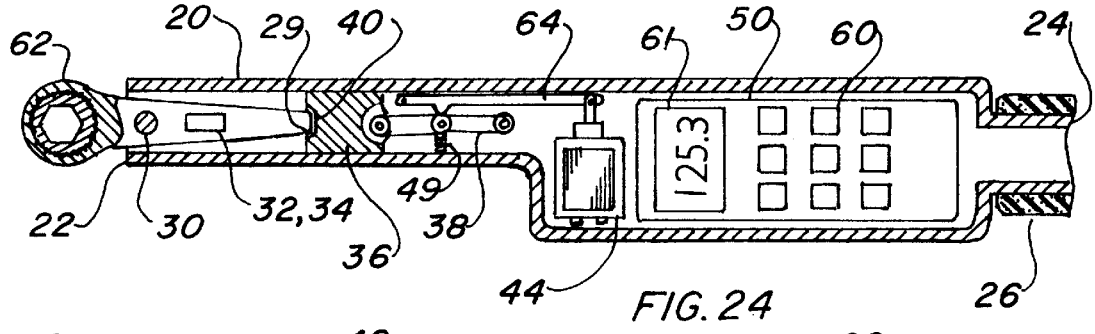
FIG. 24 is a cross sectional view taken along lines 24—24 of FIG. 23 with the wrench illustrated prior to release.
Figure 25:
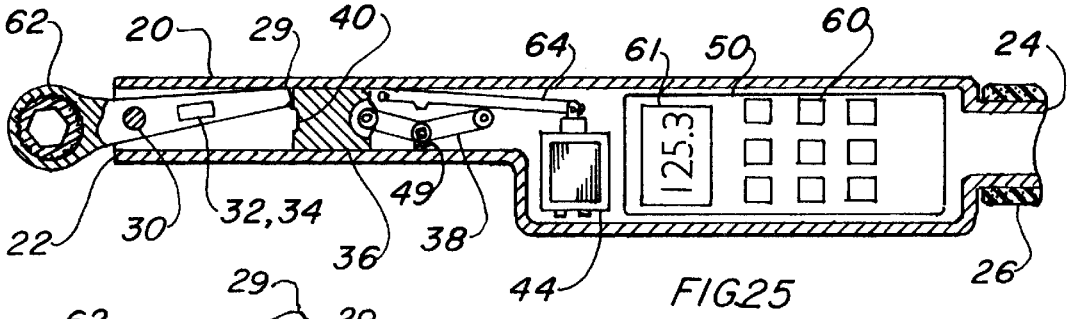
FIG. 25 is a cross sectional view taken along lines 25—25 of FIG. 23 with the wrench illustrated after release.
Figure 26:
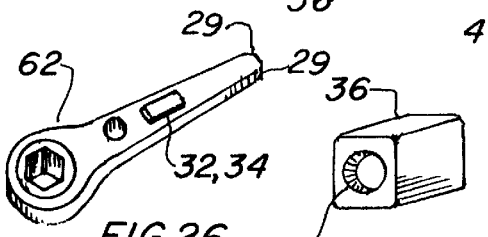
FIG. 26 is a partial isometric view of the ratchet box wrench arm completely removed from the invention for clarity.
Figure 27:
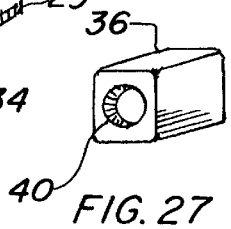
FIG. 27 is a partial isometric view of the holding cam completely removed from the invention for clarity.
Figure 28:
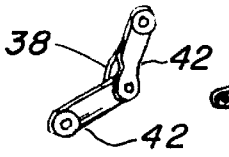
FIG. 28 is a partial isometric view of the toggle linkage completely removed from the invention for clarity.
Figure 29:
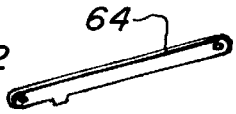
FIG. 29 is a partial isometric view of the hinged latch completely removed from the invention for clarity.
Figure 30:
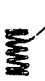
FIG. 30 is a partial isometric view of the reset spring completely removed from the invention for clarity.
Figure 31:
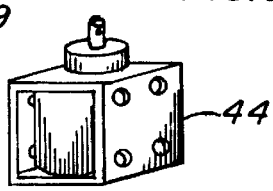
FIG. 31 is a partial isometric view of the electromagnetic solenoid completely removed from the invention for clarity.

Ratchet means, in the form of a ratchet box wrench 62 with an extending arm and operable mechanism to reverse direction of the ratchet, is disposed within the first end 22 of the enclosure 20, as shown in FIGS. 23–25. The ratchet box wrench 62 is well known in the industry and is used for attachment and rotation of a threaded fastener workpiece, such as nuts, bolts, hex capscrews, etc.

Ratchet pivot means in the form of a pivot pin 30 that penetrates through both the enclosure's first end 22 and the ratchet box wrench 62, permits the ratchet box wrench to swivel circuitously within boundaries of the enclosure 20. This limited rotational movement is illustrated in FIGS. 24 and 25, wherein FIG. 24 depicts the wrench prior to release and FIG. 25 shows the wrench after it has released, depicting the relative movement that has been allowed within boundaries created by the shape of the enclosure 20.

Force sensing means in the form of either a strain gauge transducer 32 or a force cell transducer 34, is permanently attached, with epoxy or the like, onto the ratchet box wrench 62 and its function is to convert physical torque value energy into an analog electronic signal. Both transducers 32, 34 are similar in function and are illustrated only as a rectangle in the drawings since they are well known, commonly available and in present use.

Locking latch means are in the form of a holding cam 36, toggle linkage 38, and reset spring 49 with the holding cam 36 configured to slide within the enclosure 20 and abut against the extended end of the wrench's arm 62. The arm 62 has a truncated conical end 29 which creates a small axial force. As the enclosure 20 illustrated is rectangular in shape, the holding cam 36 is formed with either a square cross section or a round cross section as illustrated, in either design, the cam is dimensioned to slide freely within the enclosure which can be in a rectangular shape, a round shape or other configurations. The holding cam 36 includes a truncated conical indentation 40 on the end that contiguously holds the wrench's arm 62 in a rigid position until a predetermined amount of torque is applied which translates a small amount of radial force to an axial force. The toggle linkage 38 consists of a pair of pivoted toggle arms 42 attached together with one end rotatably affixed to the holding cam 36, and the other end pivotally connected to the enclosure 20. The arms 42 are in a biased alignment, thereby maintaining the wrench arm 62 in a fixed, rigid position within the truncated conical indentation 40 of the holding cam 36 until a predetermined amount of torque is applied to the wrench where the alignment is disrupted.

Electromechanical actuated trigger means is in the form of an electromagnetic solenoid 44 having a bobbin and a plunger. The plunger produces a linear motion or action when the bobbin is supplied with an electrical current, thus creating an electromagnetic field which forces the plunger to be propelled, by reversed magnetic polarity, in a longitudinal direction. A hinged latch 64 is used to support the toggle arms 42 in a biased alignment, thereby disallowing movement of the ratchet box wrench 62 until the hinged latch 64 is thrust upward by the solenoid 44 upon which one end is attached. The other end of the hinged latch 64 is rotatably connected to the enclosure 20. FIGS. 24 and 25 illustrate this relationship, with FIG. 24 showing the hinged latch 64 supporting the toggle arms 42. When the solenoid 44 is energized, as depicted in FIG. 25, the toggle arms 42 are released and collapse downward from their biased position, thus releasing the ratchet box wrench 62 from the indentation 40 in the holding cam 36 and striking the inside of the enclosure 20 creating a momentary reduction in force felt by the operator. The impact of the ratchet box wrench 62 creates the desired audible clicking sound.

Figure 32:
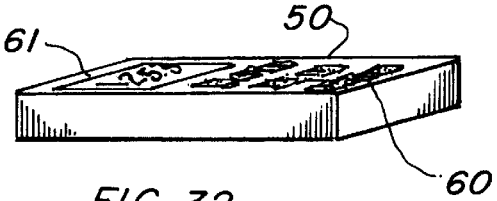
FIG. 32 is a partial isomeric view of the electronic controller completely removed from the invention for clarity.

An electronic controller 50, shown in block diagram in FIG. 66 and by itself in FIG. 32, amplifies and conditions a signal from the force sensing means, which is either a strain gauge transducer 32 or a force cell transducer 34, and utilizes a switching circuit 52 to control the solenoid 44. The controller 50 utilizes all of the same elements and functions as described in the first embodiment, with the exception of its shape which is packaged differently, as depicted in FIG. 32.

The fourth or cam-over embodiment is illustrated in FIGS. 33–45 and 66 wherein the torque wrench includes a hollow, metallic square enclosure 20. While this outline form is preferred, round, rectangular, irregular, polygonal, oval, etc. may also be used as long as it is sufficiently hollow to encase operable elements inside. Further, similar materials may be used however, metal is preferred. The enclosure 20 has a first end 22 and a second end 24, with a handle 26 attached upon the second end. The handle 26 is of a resilient material and is well known in the art. The length of the enclosure 20 is determined by the desired capacity of the torque wrench and is governed the average ability of the user to apply force to a lever arm.

Ratchet means in the form of a cam-over ratchet 68 with an operable mechanism to reverse direction of the ratchet, are disposed within the first end 22 of the enclosure 20, as shown in FIGS. 33–35. The cam-over ratchet employs a ball 70 or roller 72 that is held into a detent with cam 36. When the torque, as sensed by the strain gauge transducer 32 or force cell transducer 34 reaches the desired valve the toggle mechanism or toggle linkage 38 is released and the wheel of the cam-over ratchet 68 is allowed to rotate about its square drive resulting in a reduction in force felt by the operator. The cam-over, or slip-cam ratchet 68, includes a wheel **68*a* and a body 68*b*** and is well known in the industry and is used for the attachment and rotation of threaded fasteners.

Rotational movement is illustrated in FIGS. 34 and 35, wherein FIG. 34 depicts the wrench prior to release and FIG. 35 depicts the wrench after it has been released.

Forcing sensing means in the form of either a strain gauge transducer 32 or a force cell transducer 34 is permanently attached to the enclosure 20 as shown in FIG. 33 or onto a holding cam 36 depicted in FIGS. 34 and 35. The function of the sensing means is to convert physical torque value energy into an analog electronic signal. Both transducers 32, 34 are similar in function and are illustrated only as a rectangle with radial ends in the drawings since they are well known and in present use.

Locking latch means are in the form of a holding cam 36 and toggle linkage 38, with the holding cam 36 configured to slide within the enclosure 20 and abut against the ball or roller thus restraining the ratchet wheel **68*a*. As the enclosure 20 is square in shape, the holding cam 36 may be formed with a square cross section, or round as illustrated wherein both are dimensioned to slide freely within the enclosure. The toggle linkage 33 consists of pair of pivoted toggle arms 42 that are attached together with one end rotatably affixed to the holding cam 36 and the other end pivotally connected to the enclosure 20. The arms 42 are in biased alignment, thus maintaining the ratchet wheel 62*a* in a fixed rigid position within the ratchet body 62*b*** until a predetermined amount to torque is applied to the wrench where the alignment is disrupted.

Electromechanical actuated trigger means is in the form of an electromagnetic linear actuator 66 that includes an electric motor, a gear set and a mechanical screw, which produces linear motion or action when supplied with an electrical current. It should be noted that the actuator 66 may be substituted for the solenoid 44 in the other embodiments and visa versa. Further, a trigger lever arm 46 and a spring loaded collapsing column 48 are used to support the toggle arms 42 in biased alignment, thereby denying movement of the ratchet 68 until the lever arm 46 is thrust downward by the actuator 66 upon which one end is attached. The other end of the lever arm 46 is rotatably connected to the spring loaded column 48 and the column is affixed to the enclosure 20 and held upright by a reset spring 49. FIGS. 34 and 35 illustrate this relationship, with FIG. 34 showing the lever arm 46 and column 48 supporting the toggle arms 42. When the actuator 66 is energized, as depicted in FIG. 35, the toggle arms 42 are released and collapse downward from their bias position, thus releasing tension on the ball 70 or roller 72.

An electronic controller 50, shown in block diagram in FIG. 66 and by itself in FIG. 45, amplifies and conditions a signal from the force sensing means, and utilizes a switching circuit 52 to control the linear actuator 66. The controller 50 includes a signal conditioner 54 that receives, conditions and amplifies the analog signal from the transducer. This controller 50 is the same as described in detail in the first embodiment, however, it is illustrated housed separately from the torque wrench only as an alternate configuration. It should be noted that the arrangement of the controller 50 is of little significance, as long as the elements previously described remain intact.

The fifth embodiment of the invention is illustrated in FIGS. 46–55 and 66. This embodiment has an irregularly-shaped, hollow enclosure 20 that is preferably constructed of metal. The enclosure 20 has a first end 22 and a second end 24, with a handle 26 on the second end 24 that is fabricated of a resilient material. The overall length of the enclosure 20 is determined by the capacity of the torque wrench as governed by the ability of the user to apply a force to a lever arm and the requirements of the application.

Figure 46:
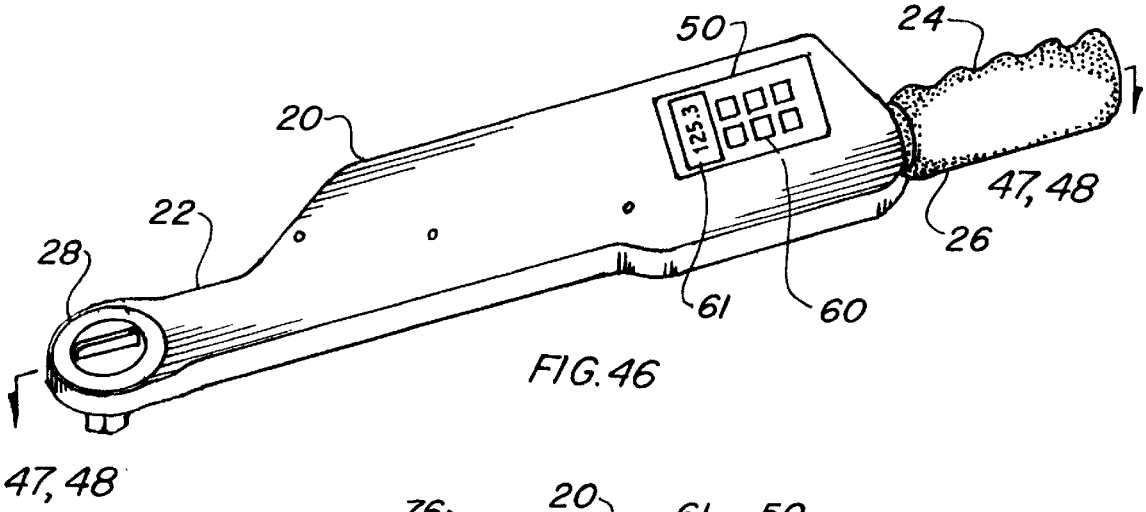
FIG. 46 is a partial isometric view of the fifth embodiment.
Figure 47:
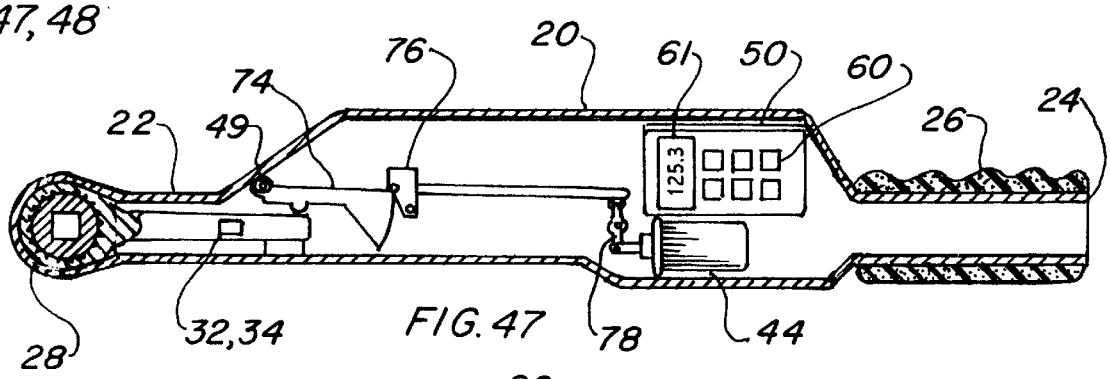
FIG. 47 is a cross sectional view taken along lines 47—47 of FIG. 46 with the wrench illustrated prior to release.
Figure 48:
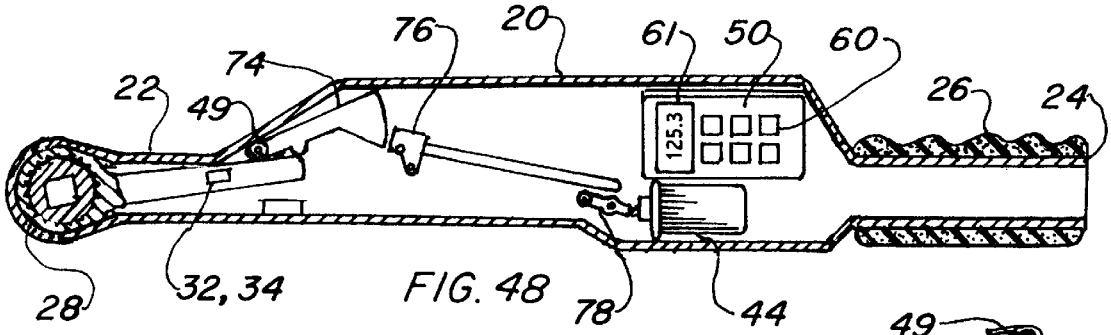
FIG. 48 is a cross sectional view taken along lines 48—48 of FIG. 46 with the wrench illustrated after release.
Figure 49:
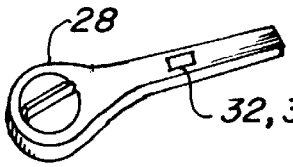
FIG. 49 is a partial isometric view of the square drive ratchet arm completely removed from the invention for clarity.
Figure 50:
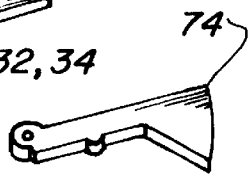
FIG. 50 is a partial isometric view of the sear completely removed from the invention for clarity.
Figure 51:
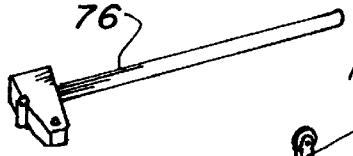
FIG. 51 is a partial isometric view of the holding pawl completely removed from the invention for clarity.
Figure 52:
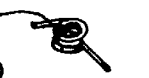
FIG. 52 is a partial isometric view of the reset spring completely removed from the invention for clarity.
Figure 53:
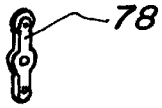
FIG. 53 is a partial isometric view of the hinged pillar completely removed from the invention for clarity.
Figure 54:
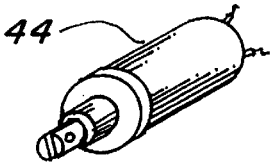
FIG. 54 is a partial isometric view of the electromagnetic solenoid completely removed from the invention for clarity.

Ratchet means, in the form of a square drive ratchet 28 with an extending arm and operable mechanism to reverse direction of the ratchet, are disposed within the first end 22 of the enclosure 20, as shown in FIGS. 46–48. The square drive ratchet 28 is well known in the industry and is used for attachment and rotation of threaded fasteners.

Ratchet pivot means in this embodiment are formed by the configuration of the enclosure 20 at the first end 22, which is enclosed by a bearing or bushing, thus permitting the ratchet to swivel within boundaries of the enclosure 20. This limited rotational movement is illustrated in FIGS. 47 and 48, wherein FIG. 47 depicts the wrench prior to release and FIG. 48 shows the wrench after it has released, thus illustrating the relative movement that has been allowed within boundaries created by the shape of the enclosure 20. It should also be noted that this configuration of the ratchet pivot means may be used on any of the other embodiments described above with equal ease.

Force sensing means, in the form of either a strain gauge transducer 32 or a force cell transducer 34, is permanently attached onto one side of the square drive ratchet 28 and its function is to convert physical torque value energy into an analog electronic signal. Both transducers 32, 34 are similar in function and are illustrated only as a rectangle in the drawings, as they are well known and commonly available, Locking latch means are in the form of a pivoted sear 74, a holding pawl 76 and reset spring 49. The sear 74 is spring loaded and contiguous with both the square drive ratchet arm 28 and the holding pawl 76, thereby maintaining the ratchet 28 in a fixed rigid position until a predetermined amount of torque is applied to the wrench when the alignment is disrupted. Both the sear 74 and holding pawl 76 are rotatably attached to the enclosure 20 preferably by pins or the like, thus allowing them to be held in a permanent yet pivotal position.

Electromechanical actuated trigger means is in the form of an electromagnetic solenoid 44 having a bobbin and a plunger. The plunger produces a linear motion or action when the bobbin is supplied with an electrical current, thus creating an electromagnetic field which forces the plunger to be propelled by reversed magnetic polarity, in a longitudinal direction. The sear 74, holding pawl 76 and a hinged pillar 78 are used to support the square drive ratchet arm 28, thereby disallowing movement of the ratchet 28 until the holding pawl 76 is released which occurs when the solenoid 44 is actuated. The hinged pillar 78 is rotatably attached to the solenoid 44 and pivoted onto the enclosure 20. The holding pawl 76 includes a notch that engages the sear 74 as shown in FIG. 47. The ratchet 28 is held in alignment with the centerline of the enclosure 20 until released. When the holding pawl 76 is rotated away from the sear 74 by the hinged pillar 78, which is attached to the solenoid 44, the rotary movement of the hinged pillar 78 disconnects the sear 74 and holding pawl 76. This action releases the ratchet 28 when a predetermined amount of torque is manually applied to the enclosure, also simultaneously producing a momentary reduction in force felt by the operator and an audible clicking sound when the ratchet strikes the enclosure.

Figure 55:
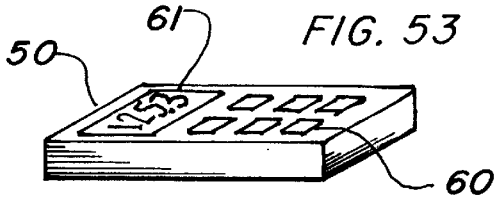
FIG. 55 is a partial isometric view of the electronic controller completely removed from the invention for clarity.

An electronic controller 50, shown in block diagram in FIG. 66 and by itself in FIG. 55, amplifies and conditions a signal from the force sensing means, which is either a strain gauge transducer 32 or a force cell transducer 34, and utilizes a switching circuit 52 to control the solenoid 44. The controller 50 includes a signal conditioner 54 that receives, conditions and amplifies the analog signal from the transducer. The controller 50 utilizes all of the same elements and functions as described in the first embodiment with the exception of its shape, which is packaged differently as depicted in FIG. 55.

The sixth embodiment of the invention is illustrated in FIGS. 56–65. This embodiment also has an enclosure 20 that is comprised of a hollow structure, irregular in shape with metal utilized as the preferred material. The enclosure 20 has a first end 22 and a second end 24, with a handle 26, on the second end 24, fabricated of a resilient material. The overall length of the enclosure 20 is determined by the capacity of the torque wrench is governed by the ability of the user to apply force to a lever arm and the requirements of the application.

Figure 56:
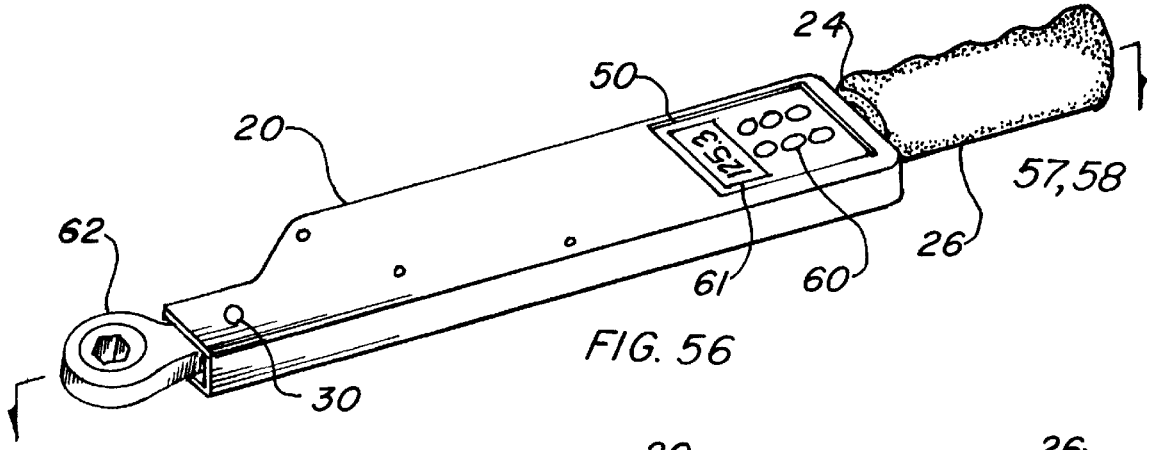
FIG. 56 is a partial isometric view of the sixth embodiment.
Figure 57:
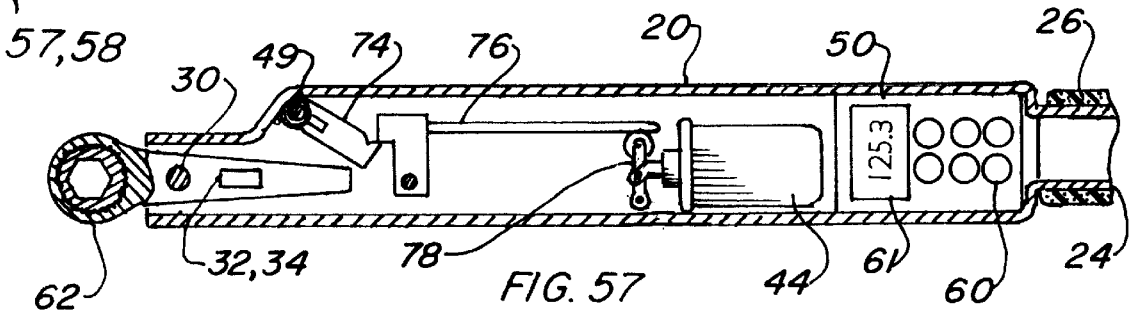
FIG. 57 is a cross sectional view taken along lines 57—57 of FIG. 56 with the wrench illustrated prior to release.
Figure 58:
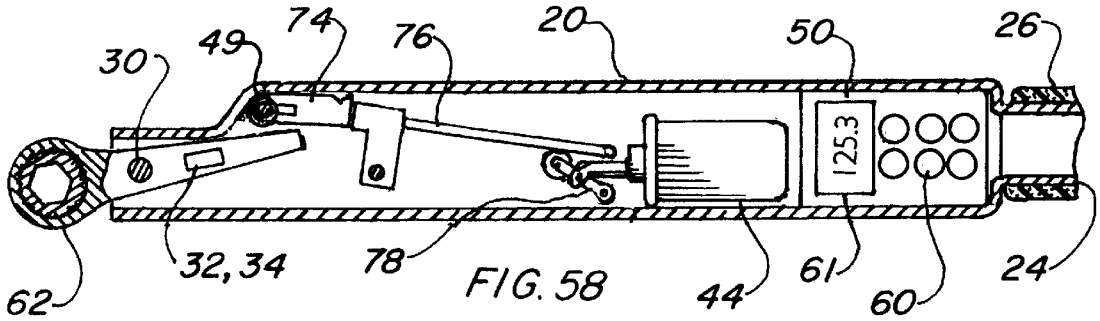
FIG. 58 is a cross sectional view taken along lines 58—58 of FIG. 56 with the wrench illustrated after release.
Figure 59:
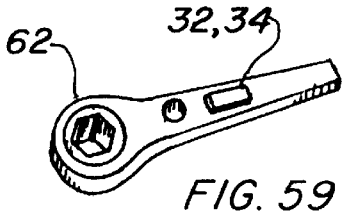
FIG. 59 is a partial isometric view of the ratchet box wrench arm completely removed from the invention for clarity.
Figure 60:
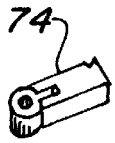
FIG. 60 is a partial isometric view of the sear completely removed from the invention for clarity.
Figure 61:
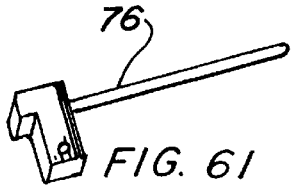
FIG. 61 is a partial isometric view of the holding pawl completely removed from the invention for clarity.
Figure 62:
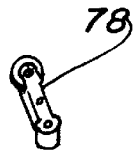
FIG. 62 is a partial isometric view of the hinged pillar with a roller completely removed from the invention for clarity.
Figure 63:
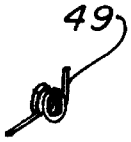
FIG. 63 is a partial isometric view of the hinged pillar spring completely removed from the invention for clarity.
Figure 64:
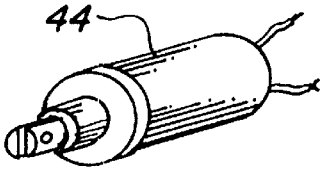
FIG. 64 is a partial isometric view of the electromagnetic solenoid completely removed from the invention for clarity.

Ratchet means, in the form of a ratchet box wrench 62 with an extending arm and operable mechanism to reverse direction of the ratchet, are disposed within the first end 22 of the enclosure 20, as shown in FIGS. 56–58. The ratchet box wrench 62 is well known in the industry and is used for attachment and rotation of threaded fasteners, other types of ratchets can also be used.

Ratchet pivot means, are in the form of a pivot pin 30 that penetrates through both the enclosure's first end 22 and the ratchet box wrench 62, permit the ratchet box wrench 62 to swivel circuitously within the boundaries of the enclosure 20. This limited rotational movement is illustrated in FIGS. 57 and 58, wherein FIG. 57 depicts the wrench prior to release and FIG. 58 shows the wrench after it has released, thus illustrating the relative movement that has been allowed within boundaries created by the shape of the enclosure 20.

Force sensing means, in the form of either a strain gauge transducer 32 or a force cell transducer 34 is permanently attached onto one side of the ratchet box wrench 62 and its function is to convert physical torque value energy into an analog electronic signal. Both transducers 32,34 are similar in function and are illustrated only as a rectangle in the drawings as they are well known and commonly available.

Locking latch means are in the form of a pivoted sear 74 and a holding pawl 76. The sear 74 is contiguous with both the ratchet box wrench 62 and the holding pawl 76, thus maintaining the ratchet box wrench 62 in a fixed rigid position until a predetermined amount of torque is applied to the wrench when the alignment is disrupted. Both the sear 74 and holding pawl 76 are rotatably attached to the enclosure 20 preferably by pins or the like, thereby allowing them to be held in a permanent yet pivotal position.

Electromechanical actuated trigger means are in the form of an electromagnetic solenoid 44 having a bobbin and a plunger. The plunger produces a linear motion or action when the bobbin is supplied with an electrical current, thus creating an electromagnetic field which forces the plunger to be propelled, by reversed magnetic polarity, in a longitudinal direction. The spring loaded sear 74, holding pawl 76 and a hinged pillar 78 are used to support the ratchet box wrench 62, thereby disallowing movement of the ratchet box wrench 62 until the holding pawl 76 is released when the solenoid 44 is actuated. The hinged pillar 78 is rotatably attached to the solenoid 44 and pivoted onto the enclosure 20. The sear 74 is loaded with a reset spring 49 and also includes a notch that engages the holding pawl 76, as shown in FIG. 57. The ratchet box wrench arm 62 is held in alignment with the center line of the enclosure 20 until released, when the holding pawl 76 is rotated away from the sear 74 by the hinged pillar 78 which is attached to the solenoid 44. The rotary movement of the hinged pillar 78 disconnects the sear 74 and holding pawl 76, thus releasing the ratchet box wrench 62 when a predetermined amount of torque is manually applied to the enclosure, resulting in a momentary reduction of force felt by the operator, also simultaneously producing an audible clicking sound when the ratchet's arm 62 strikes the enclosure.

Figure 65:
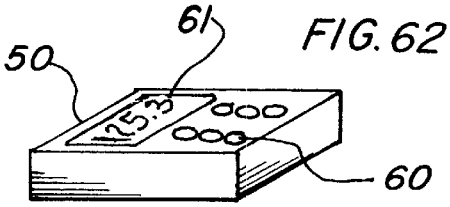
FIG. 65 is a partial isometric view of the electronic controller completely removed from the invention for clarity.

The hinged pillar utilizes a spring 80 to maintain its upright position and to reset the pawl and sear when released, An electronic controller 54, shown in block diagram in FIG. 66 and by itself in FIG. 65, amplifies and conditions a signal from the force sensing means, by utilizing either a strain gauge transducer 32 or a force cell transducer 34, and a switching circuit 52 to control the solenoid 44. The controller 50 includes a signal condition 54 that receives, conditions and amplifies the analog signal from the transducer. The controller 50 utilizes all of the same elements and function as described in the first embodiment with the exception of its shape which is packaged differently as depicted in FIG. 65.

Operation

To operate all the embodiments, the user manually sets the desired torque-release-point on the keypad 60 of the electronic controller 50 and then attaches the wrench to the workpiece with the ratchet means, which pivotally protrudes from the enclosure 20. The user tightens the workpiece threaded fastener, and the force sensing means attached to the ratchet 28, 62 or 68 produces an analog signal to the controller. When the release point is reached, the controller 50 sends a signal to the solenoid 44 or linear actuator 66, thus creating linear motion which causes the locking latch and trigger means to disconnect the ratchet, thereby producing a momentary reduction in force felt by the operator and an audible clicking sound when the ratchet 28 or 62 strikes the enclosure or when the ball 70 is disengaged from the wheel.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. An electromechanical releasing torque wrench comprising:

a) an elongated enclosure having a first end and a second end with a handle disposed upon the second end, wherein said enclosure is a hollow metallic structure and irregular in shape, b) ratchet means disposed within with the first end of the enclosure for attachment and rotation of a threaded fastener workpiece, c) ratchet pivot means proximately adjoining the enclosure first end, allowing limited swiveling of the ratchet means within the enclosure, d) force sensing means contiguously engaging said ratchet means converting physical torque value energy into an analog electronic signal, e) locking latch means having a mechanical advantage, abutting and retaining said ratchet means in a fixed rigid position until a predetermined amount of torque is applied to the wrench, said mechanical advantage reducing level of applied torque, f) electromechanical actuated trigger means having mechanical motion and Interfacing with the locking latch means such that when a predetermined amount of torque is manually applied to the wrench both the locking latch and ratchet means are released by movement of the trigger means using the mechanical advantage of the locking latch means, simultaneously producing a momentary reduction in force felt by the operator and an audible clicking sound as the ratchet means strikes the enclosure, and g) an electronic controller amplifying and conditioning a signal from the force sensing means and switching a circuit to control the trigger means.

2. The torque wrench as recited in claim 1 wherein said ratchet means further comprises a ratchet box wrench having an extending arm and means to reverse direction of rotation of the wrench.

3. The torque wrench as recited in claim 1 wherein said locking latch means having a mechanical advantage further comprises a holding cam and a toggle linkage with the holding cam slideably disposed within the enclosure contiguous with the ratchet means on one end and the toggle linkage on the other, said toggle linkage constituting a pair of pivoted toggle arms held in a biased alignment by said trigger means maintaining said ratchet means in a fixed rigid position until a predetermined amount of torque is applied to the wrench.

4. The torque wrench as recited in claim 1 wherein said trigger means further comprises a sear, a holding pawl and a hinged pillar with the sear pivotally attached to the enclosure and continuously engaging both the ratchet means and the holding pawl such as the ratchet means is held rigidly until released when the hinged pillar which is attached to the electromechanical portion of the trigger means, the linear movement of the hinged pillar disconnects the sear and holding pawl thus releasing the ratchet means when a predetermined amount of torque is manually applied to the enclosure, also simultaneously producing a momentary reduction in force felt by the operator and an audible clicking sound when the ratchet strikes the enclosure.

5. The torque wrench as recited in claim 1 wherein said electronic controller further comprises:

a) a transducer which converts an applied physical torque value into an equivalent analog signal, b) a signal conditioner which receives, conditions and amplifies the analog signal, c) an analog-to-digital converter which converts the conditioned and amplified analog signal into an equivalent digital signal, d) a microprocessor having means for:

(1) entering a torque-release set point corresponding to the torque-release value required by a user, and (2) receiving and comparing the digital signal with the torque-release set point, wherein when the digital signal and torque-release point are equal, a wrench release signal is produced by said microprocessor, and e) a switching circuit that is activated by the wrench release-signal, whereupon a trigger signal is produced that energizes the electromechanical actuated trigger means on said wrench releasing the ratchet means which also produces an audible clicking sound.

6. The torque wrench as recited in claim 5 wherein said transducer comprises a wheatstone-bridge strain gauge circuit.

7. The torque wrench as recited in claim 5 wherein said means for entering a torque-release set point comprises a keypad.

8. An electromechanical releasing torque wrench comprising:

a) an elongated hollow irregular shaped enclosure having a first end and a second end with a handle disposed upon the second end, b) a ratchet box wrench disposed within with the first end of the enclosure for attachment and rotation of a threaded fastener workpiece, c) ratchet pivot means proximately adjoining the enclosure first end, having a pivot pin through both the enclosure and the ratchet, allowing limited swiveling of the ratchet within the enclosure, d) force sensing means continuously engaging said ratchet means converting physical torque value energy into an analog electronic signal, e) locking latch means defining a holding cam and a toggle linkage abutting and retaining said ratchet means in a fixed rigid position until a predetermined amount of torque is applied to the wrench, f) electromechanical actuated trigger means having mechanical motion, wherein said trigger means further comprises a sear, a pawl and a spring loaded hinged pillar with the sear pivotally attached to the enclosure and contiguously engaging both the box wrench and the pawl such that the box wrench is held rigidly until released when the pawl is rotated away from the sear by the hinged pillar which is attached to the electromechanical portion of the trigger means, the rotary movement of the hinged pillar disconnects the sear and pawl thus releasing the ratchet when a predetermined amount of torque is manually applied to the enclosure, also simultaneously producing a momentary reduction in force felt by the operator and an audible clicking sound when the ratchet strikes the enclosure, and g) an electronic controller amplifying and conditioning a signal from the force sensing means and switching a circuit to control the trigger means.

* * * * *